US006982739B2

(12) United States Patent
Misawa et al.

(10) Patent No.: US 6,982,739 B2
(45) Date of Patent: Jan. 3, 2006

(54) TUBE THERMAL TRANSFER PRINTER MACHINE

(75) Inventors: Takahisa Misawa, Tokyo (JP); Takefumi Kobayashi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/505,412

(22) PCT Filed: Feb. 25, 2003

(86) PCT No.: PCT/JP03/02053

§ 371 (c)(1),
(2), (4) Date: Aug. 24, 2004

(87) PCT Pub. No.: WO03/072364

PCT Pub. Date: Sep. 4, 2003

(65) Prior Publication Data

US 2005/0134674 A1 Jun. 23, 2005

(30) Foreign Application Priority Data

Feb. 28, 2002 (JP) ..... 2002-054823

(51) Int. Cl.
*B41J 11/00* (2006.01)

(52) U.S. Cl. ..... 347/220

(58) Field of Classification Search ..... 347/2, 347/4, 171, 197, 215, 218, 220, 221, 222; 101/35–37, 40, 41, 44; 400/120.01; 118/620, 118/630, 696

See application file for complete search history.

(56) References Cited

U.S. PATENT DOCUMENTS 4,534,313 A * 8/1985 Louvel ..... 118/696
5,353,699 A * 10/1994 Tamura ..... 101/35

FOREIGN PATENT DOCUMENTS

| | | |
|---|---|---|
| JP | 6-74345 U | 10/1994 |
| JP | 8-104016 | 4/1996 |
| JP | 8-238786 | 9/1996 |
| JP | 11-334154 | 12/1999 |
| JP | 2000-264516 | 9/2000 |

* cited by examiner

*Primary Examiner*—K. Feggins
(74) *Attorney, Agent, or Firm*—Morgan, Lewis & Bockius LLP

(57) ABSTRACT

A thermal transfer printer passing a long soft tube (5) and an ink ribbon (4) between a platen roller (2) rotatably provided at a printer main body (1) and a printing head (3) arranged opposedly to the platen roller (2) and printing a character by thermal transcription from the printing head (3) to the tube (5), in which a hard wrapping roller (8) is rotatably arranged upstream from the printing head (3) and opposedly to the platen roller (2) and a character is printed by deforming the tube (5) between the platen roller (2) and the wrapping roller (8) such that a portion thereof brought into contact with the wrapping roller (8) is constituted by a planer shape.

3 Claims, 3 Drawing Sheets

TUBE THERMAL TRANSFER PRINTER MACHINE

TECHNICAL FIELD

The present invention relates to a tube thermal transfer printer for printing a soft tube.

BACKGROUND ART

Generally, an electric equipment of a switch board or the like is integrated with a number of electric wires and therefore, the electric wires are indicated with characters or signs in order to show kinds or functions of the respective electric wires. In that case, the character or the sign cannot directly be printed to the electric wire and therefore, the character or the sign is printed to a short tube and indicated by inserting the electric wire into the tube.

A tube is printed by a thermal transfer printer. That is, a long tube is passed between a platen roller and a printing head of the thermal transfer printer along with an ink ribbon, the tube is fed while rotating the platen roller, the printing head is partially heated, and ink of the ink ribbon is melted to thermally transcribe on a surface of the tube. After printing, the tube is cut in a predetermined length to use.

In order to feed the tube to the printing head, there is constructed a constitution of arranging a wrapping roller at a position opposed to the platen roller, passing the tube between the platen roller and the wrapping roller and feeding the tube to the printing head by rotating the platen roller. At this occasion, in order to firmly feed the tube, there is constructed a constitution in which also the wrapping roller is made to be soft (made of rubber) similar to the platen roller to thereby increase an area thereof brought into contact with the tube. Further, the tube is brought into a state of being deformed between the platen roller and the wrapping roller and is fed to the printing head under the state.

In this way, the tube is deformed between the wrapping roller and the platen roller immediately before printing and a surface of the deformed tube is printed. Further, since the printing head is formed in a planer shape and therefore, it is preferable that the deformed portion is as flat as possible.

However, the character printed on the surface of the tube is not necessarily excellent. When the printed character is observed in details, it has been found that the character seems to be blurred at a central portion thereof. Hence, as a result of investigating a cause thereof, according to the above-described failure in printing, when the tube is deformed, as shown by FIG. 4, although walls on both sides of a central portion a of a portion deformed between the wrapping roller 10 and the platen roller 11 are brought into contact with each other, both ends b thereof are produced with spaces on inner sides thereof since there is a limit in elasticity of the tube 5. Therefore, a section thereof is liable to be formed substantially in a "8"-like shape. Therefore, it has been found that the failure in printing is caused by printing the character while the central portion stays to be recessed. Particularly, as shown by FIG. 5, in deforming the tube 5 having a section formed with recessed and projected grooves at an inner face thereof, the tube 5 is further difficult to be a plane.

DISCLOSURE OF THE INVENTION

The invention has been established in view of the above-described problem and it is a problem thereof to provide a tube thermal transfer printer to always achieve excellent printing by making a printing face of a tube as plane as possible when the tube is deformed.

In order to resolve the above-described problem, a tube thermal transfer printer according to the invention is characterized in a tube thermal transfer printer passing a long tube and an ink ribbon between a platen roller rotatably provided at a printer main body and a printing head arranged opposedly to the platen roller and printing a character by thermal transcription from the printing head to the tube, wherein a wrapping roller is rotatably arranged upstream from the printing head and opposedly to the platen roller, the tube is deformed between the platen roller and the wrapping roller, and the character is printed by deforming a portion thereof brought into contact with the wrapping roller is constituted by a plane shape.

Further, in the above-described tube thermal transfer printer, a peripheral face of the wrapping roller may be provided with a recessed portion and both ends edge thereof may be projected more than a central portion thereof. Thereby, both ends of the tube are pressed more strongly than the central portion to deform and therefore, excellent printing can further stably be realized.

Further, for example, by constituting a hardness of the platen roller to be 60° in rubber hardness and constituting a hardness of the wrapping roller to be 100° in brass hardness, the tube in a state of being deformed in a flat shape can firmly be fed to the printing head.

Figure 1:
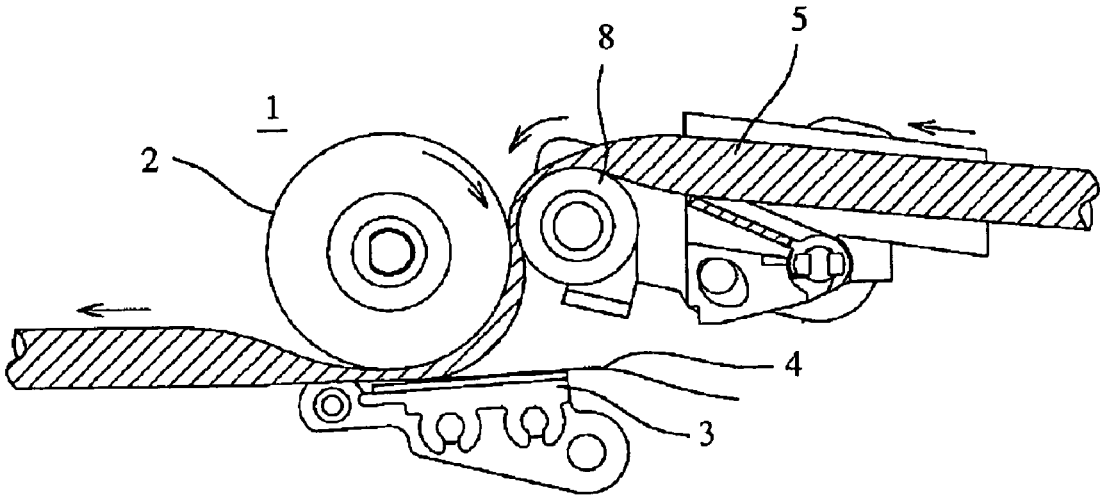
FIG. 1 is a plane view of an essential portion of a thermal transfer printer.

Further, in notations in the drawings, numeral 2 designates a platen roller, numeral 3 designates a printing head, numeral 5 designates a tube and numeral 8 designates a wrapping roller.

BEST MODE FOR CARRYING OUT THE INVENTION

FIG. 1 shows an essential portion of a printer. In the printer, a platen roller 2 is rotatably arranged, and a printing head 3*a* is arranged opposedly to the platen roller 2. In a vicinity of the printing head 3, is an ink ribbon roller (not illustrated) is arranged. An ink ribbon 4 for thermal transcription wrapped around the ink ribbon roller is passed to cover a surface of the printing head 3 and is wound by a winding reel (not illustrated) for winding the ink ribbon.

Further, a portion for containing the long tube 5 is formed in the printer, and the tube 5 drawn out from the containing portion is passed between the platen roller 2 and the printing head 3 and fed out to a discharging portion.

Upstream from the printing head 3, the wrapping roller 8 is rotatably arranged to be opposed to the platen roller 2. The wrapping roller 8 is constituted by a hard material, for example, hard rubber, hard plastic, metal or the like.

In the above-described constitution, the tube 5 is set to pass between the platen roller 2 and the wrapping roller 8 and to pass further between the platen roller 2 and the printing head 3. Further, after inputting a pertinent character or sign by a keyboard (not illustrated) of the printer, when printing is carried out, the platen roller 2 is rotated. The tube 5 is strongly brought into press contact with the platen roller 2 by the wrapping roller 8 and therefore, the tube 5 is fed in a direction of rotating the platen roller 2 by friction resistance thereof. At the same time, a portion of the printing head 3 in correspondence with the inputted character or sign is heated and therefore, ink of the ink ribbon 4 is melted to be thermally transcribed to the tube 5. In this way, the tube 5 is printed with a predetermined character or sign. Thereafter, the printed tube 5 is cut by a pertinent length to discharge.

Figure 2:
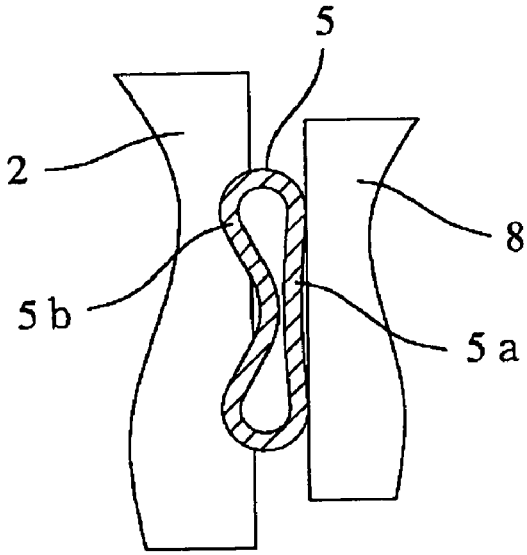
FIG. 2 is a sectional view of a tube pinched between a wrapping roller and a platen roller.

Since a gap between the wrapping roller 8 and the platen roller 2 is narrow, the tube 5 is brought into a deformed state in passing between the wrapping roller 8 and the platen roller 2. Although the platen roller 2 is constituted by soft rubber, in contrast thereto, the wrapping roller 8 is constituted by the hard material and therefore, as shown by FIG. 2, a portion 5*a* of the tube 5 on a side of the wrapping roller 8 is formed in a planer shape and a portion 5*b* thereof on a side opposed to the tube 5 is deformed to bite a side of the soft platen roller 2 by that amount. A face of the tube 5 brought into contact with the printing head 3 is a face thereof brought into contact with the wrapping roller 8, that is, the face 5*a* deformed in the planer shape and therefore, the tube 5 is brought into contact with the printing head 3 in a state of being proximate to a plane.

Although the tube 5 is going to be recovered to an original shape by inherent elasticity thereof after passing between the wrapping roller 8 and the platen roller 2, since rotation of the platen roller 2 is fast, printing is carried out in a state in which the face of the tube 5 stays to be in the planer shape before recovering deformation thereof.

As described above, the material constituting the wrapping roller 8 is harder than the material constituting the platen roller 2. Specifically, it is preferable that a hardness of the platen roller 2 is 60° in rubber hardness when the hardness is indicated as a numerical value calculated by the hardness testing method of JIS K625. Meanwhile, it is preferable that a hardness of the wrapping roller 8 is 100° in brass hardness. The brass hardness is a hardness in correspondence with a case of converting the hardness of the hard material used in the wrapping roller 8 into the rubber hardness and the brass hardness 100° signifies that the wrapping roller 8 is not bent.

As described above, printing is carried out under a state in which a printing face of the tube 5 is not so much deformed and therefore, there is not a failure in printing of a blurred character or the like, finishing is improved and the stable printing can be realized.

Figure 3:
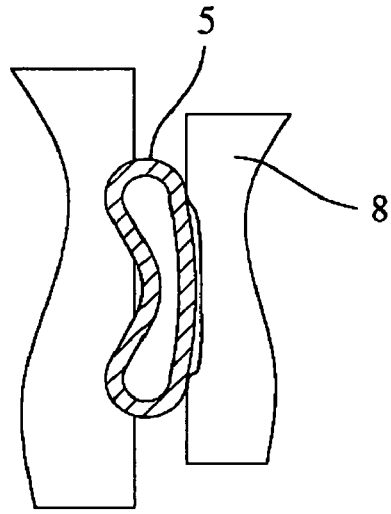
FIG. 3 is a sectional view of other example of the wrapping roller.
Figure 4:
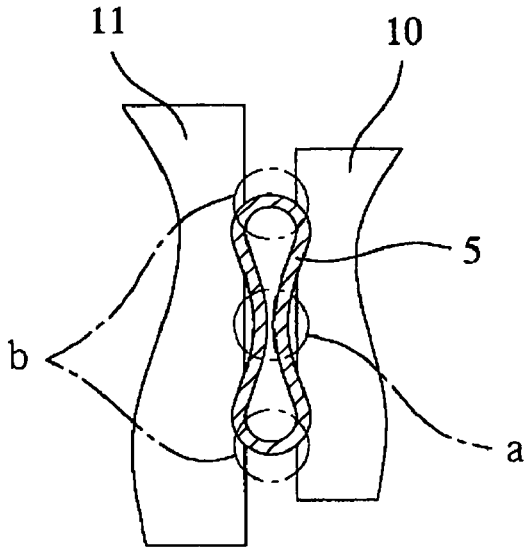
FIG. 4 is a sectional view showing a state of feeding a tube of a background art.
Figure 5:
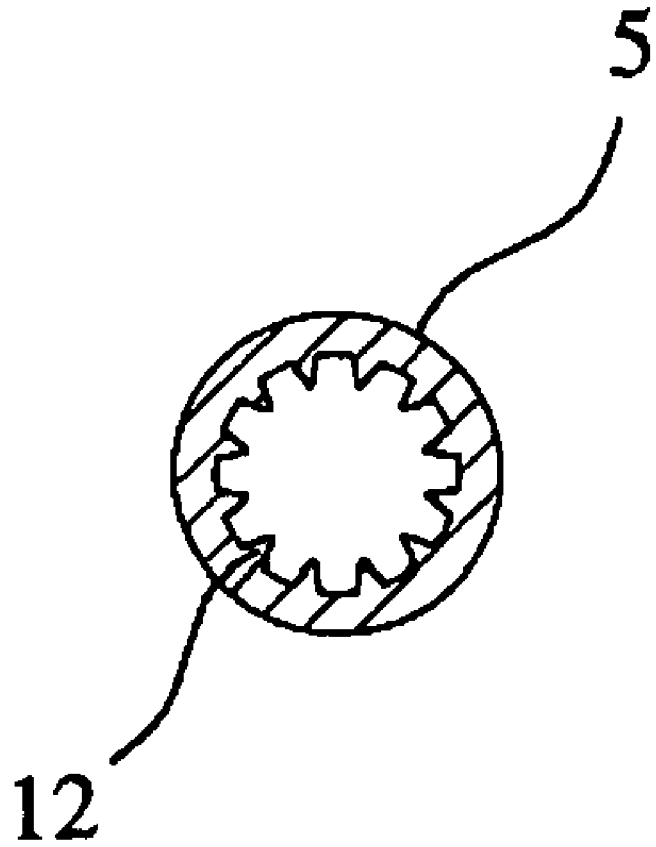
FIG. 5 is a sectional view of an example of a tube.

Next, FIG. 3 shows other embodiment which is formed such that a peripheral face of the wrapping roller 8 is formed in a recessed shape and both end edges thereof are projected more than a center thereof. When the tube 5 is passed between the wrapping roller 8 and the platen roller 2, both ends of the tube 5 are pressed more strongly than a central portion thereof to deform and therefore, similar to the above-described example, a face thereof brought into contact with the wrapping roller 8 is formed in the planer shape and is brought into contact with the printing head 3 in the state proximate to the plane before recovering the deformation of the deformed tube 5. Therefore, excellent printing can stably be realized.

Further, the invention is not limited to the above-described embodiments, but can be variously modified within the technical range of the invention and the invention naturally covers the modifications.

The application is based on Japanese Patent Application (JP-2002-054823) filed on Feb. 28, 2002 and the contents thereof are incorporated here by reference.

INDUSTRIAL APPLICABILITY

As described above, there is constructed the constitution in which the wrapping roller 8 arranged upstream from the printing head 3 is made to be hard, the tube 5 is fed to the printing head 3 in the state of deforming the printing tube 5 in the flat shape between the platen roller 2 and the wrapping roller 8 and the printing is carried out before recovering deformation of the deformed tube 5 and therefore, the printing is carried out in a state in which a recess at the center of the printing face of the tube 5 is not so much produced and therefore, even in the case of any type a tube, there is not a failure in printing a blurred character or the like, finishing is improved and stable printing can be realized.

What is claimed is:

1. A tube thermal transfer printer comprising:

a platen roller rotatbly provided at a main body of a printer for feeding out of a tube;

a printing head arranged to be opposed to the platen roller;

an ink ribbon; and a wrapping roller arranged upstream from the printing head and rotatbly to be opposed to the platen roller, wherein a portion of the tube brought into contact with the wrapping roller is deformed in a planer shape by deforming the tube between the platen roller and the wrapping roller, the tube and the ink ribbon are passed between the platen roller and the printing head, and the tube is printed by the printing head, and wherein a peripheral face of the wrapping roller includes a recessed portion, and both end edges of the peripheral face are projected more than a center portion thereof.

2. A tube thermal transfer printer comprising:

a platen roller rotatbly provided at a main body of a printer for feeding out of a tube;

a printing head arranged to be opposed to the platen roller;

an ink ribbon; and a wrapping roller arranged upstream from the printing head and rotatbly to be opposed to the platen roller.

wherein a portion of the tube brought into contact with the wrapping roller is deformed in a planer shape by deforming the tube between the platen roller and the wrapping roller, the tube and the ink ribbon are passed between the platen roller and the printing head, and the tube is printed by the printing head, and wherein a material of the wrapping roller is harder than a material of the platen roller.

3. A tube thermal transfer printer comprising:

a platen roller rotatbly provided at a main body of a printer for feeding out of a tube;

a printing head arranged to be opposed to the platen roller;

an ink ribbon; and a wrapping roller arranged upstream from the printing head and rotatbly to be opposed to the platen roller, wherein a portion of the tube brought into contact with the wrapping roller is deformed in a planer shape by deforming the tube between the platen roller and the wrapping roller, the tube and the ink ribbon are passed between the platen roller and the printing head, and the tube is printed by the printing head, and wherein a material of the wrapping roller is harder than a material of the platen roller, wherein a hardness of the platen roller is 60° in rubber hardness and a hardness of the wrapping roller is 100° in brass hardness.

* * * * *